US006994383B2

(12) United States Patent
Morris

(10) Patent No.: US 6,994,383 B2
(45) Date of Patent: Feb. 7, 2006

(54) CREMONE BOLT OPERATOR

(75) Inventor: Eric D. Morris, Philadelphia, PA (US)

(73) Assignee: Von Morris Corporation, Camden, NJ (US)

( * ) Notice: Subject to any disclaimer, the term of this patent is extended or adjusted under 35 U.S.C. 154(b) by 0 days.

(21) Appl. No.: 10/819,737

(22) Filed: Apr. 7, 2004

(65) Prior Publication Data

US 2004/0239121 A1 Dec. 2, 2004

Related U.S. Application Data

(60) Provisional application No. 60/461,724, filed on Apr. 10, 2003.

(51) Int. Cl.
*E05C 1/06* (2006.01)

(52) U.S. Cl. ..... 292/160; 292/39; 292/51; 292/112; 292/172; 292/142; 292/199; 292/279; 292/DIG. 53; 292/DIG. 64

(58) Field of Classification Search ..... 292/39, 292/51, 112, 142, 160, 172, 199, 279, DIG. 53, 292/DIG. 64
See application file for complete search history.

(56) References Cited

U.S. PATENT DOCUMENTS

| | | | | | |
|---|---|---|---|---|---|
| 228,241 | A | * | 6/1880 | Zimmerman | 292/39 |
| 1,195,594 | A | * | 8/1916 | Kohut | 292/39 |
| 1,334,314 | A | * | 3/1920 | Parsons | 292/39 |
| RE15,619 | E | * | 6/1923 | Massoll | 292/39 |
| 2,166,535 | A | * | 7/1939 | Einar et al. | 292/5 |
| 2,486,460 | A | * | 11/1949 | Bonenberger | 292/34 |
| 4,002,360 | A | * | 1/1977 | Frank et al. | 292/336.3 |
| 4,063,763 | A | * | 12/1977 | van Herpen | 292/39 |
| 4,616,864 | A | | 10/1986 | Douglas | |
| 4,658,664 | A | | 4/1987 | Jacobs et al. | |
| 4,848,811 | A | * | 7/1989 | Laufenburg et al. | 292/142 |
| 4,932,696 | A | | 6/1990 | White | |
| 4,986,582 | A | * | 1/1991 | Sting et al. | 292/336.3 |
| 5,088,776 | A | * | 2/1992 | James | 292/33 |
| 5,102,174 | A | * | 4/1992 | Prevot | 292/336.3 |
| 5,118,143 | A | * | 6/1992 | Gerard | 292/39 |
| 5,253,903 | A | * | 10/1993 | Daley | 292/39 |
| 5,253,917 | A | * | 10/1993 | Brueggemann | 296/218 |
| 5,437,485 | A | * | 8/1995 | Goldschmidt | 292/142 |

(Continued)

OTHER PUBLICATIONS

International Search Report dated Jul. 14, 2005, for International Application No. PCT/U/S04/10967.

*Primary Examiner*—Brian E. Glessner
*Assistant Examiner*—Carlos Lugo
(74) *Attorney, Agent, or Firm*—Caesar, Rivise, Bernstein, Cohen, & Pokotilow, Ltd.

(57) ABSTRACT

A cremone bolt operator is provided which includes a small and a large pinion gear, each having gear teeth and a central aperture, a first and a second rack gear, each having a first and a second set of parallel teeth, the rack gears in opposed relation to one another wherein the first and second sets of teeth are in facing relation. The first set of teeth on each of the rack gears is in meshed engagement with the small pinion gear and the second set of teeth on each of the rack gears is in meshed engagement with large pinion gear. A spindle is sized to fit in each of the central apertures of the small and large pinion gears. A locking device that causes the spindle to selectively engage either the small pinion gear or the large pinion gear.

14 Claims, 10 Drawing Sheets

U.S. PATENT DOCUMENTS 5,482,334 A * 1/1996 Hotzl ..... 292/357
5,509,703 A * 4/1996 Lau et al. ..... 292/1
5,685,584 A 11/1997 Baren et al.
5,707,090 A * 1/1998 Sedley ..... 292/172
5,794,467 A * 8/1998 Justice ..... 70/118
5,887,915 A * 3/1999 Ramsauer ..... 292/160
5,951,068 A * 9/1999 Strong et al. ..... 292/39
6,035,674 A * 3/2000 Nickel ..... 70/103
6,374,651 B1 * 4/2002 Thielmann et al. ..... 70/210
6,871,884 B2 * 3/2005 Hoffmann et al. ..... 292/39
2004/0066046 A1 * 4/2004 Becken ..... 292/39

* cited by examiner

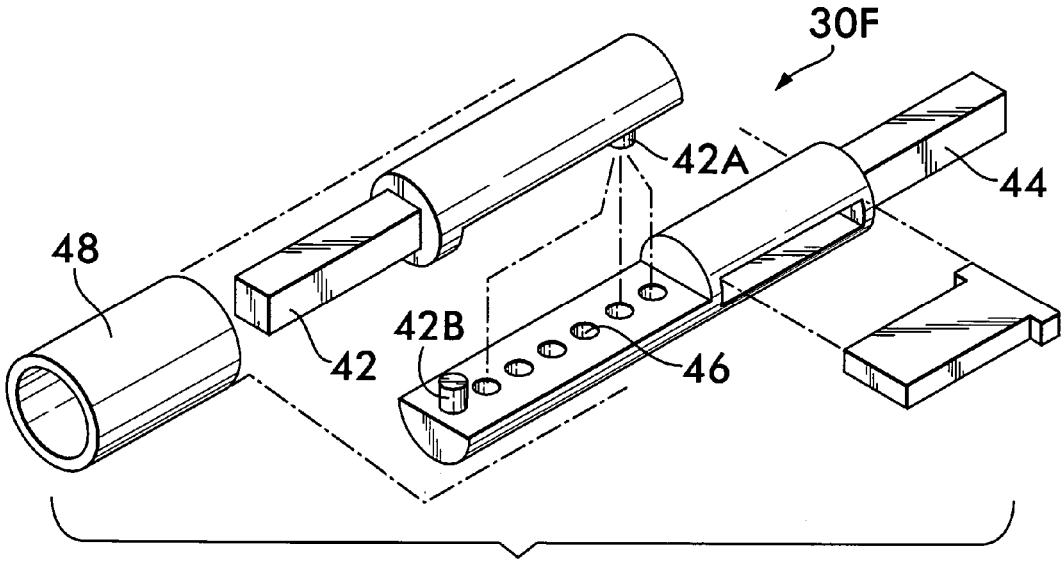
FIG.8
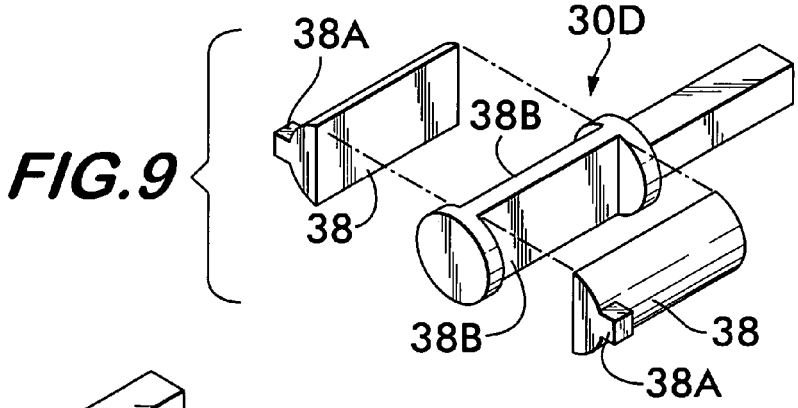
FIG.9
FIG.10
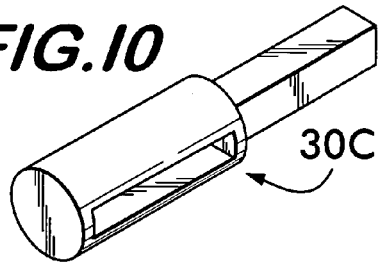
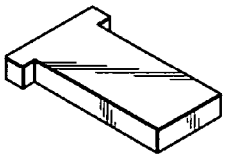
FIG.11
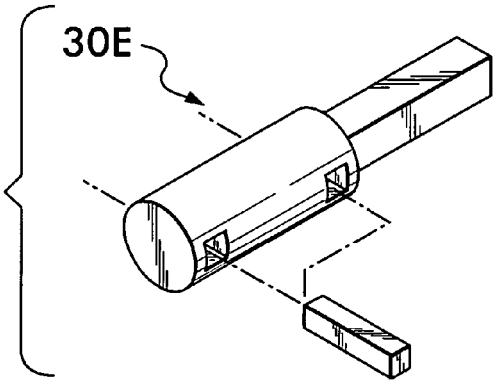
FIG.12

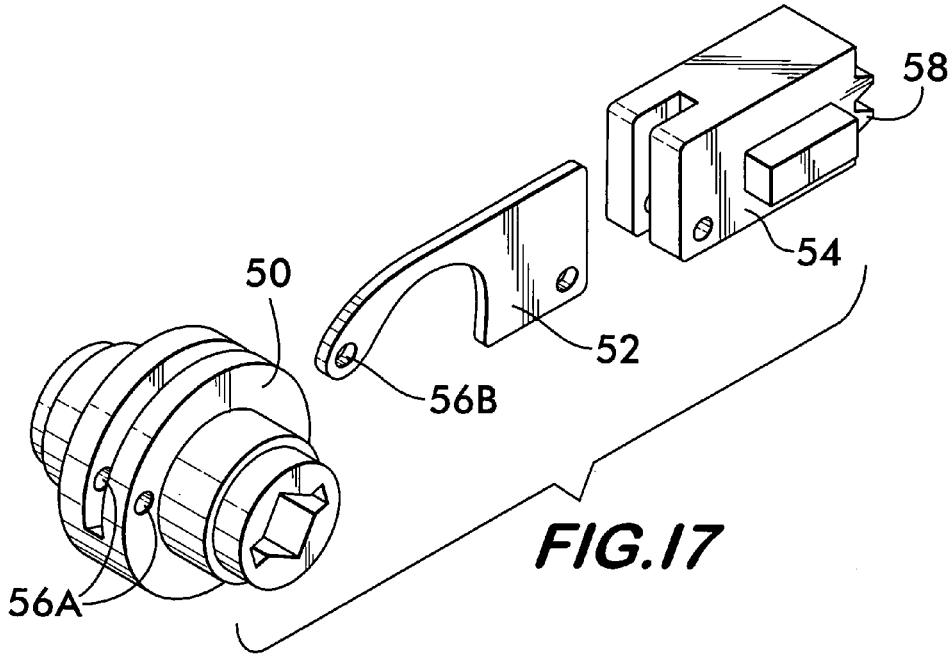
FIG.17
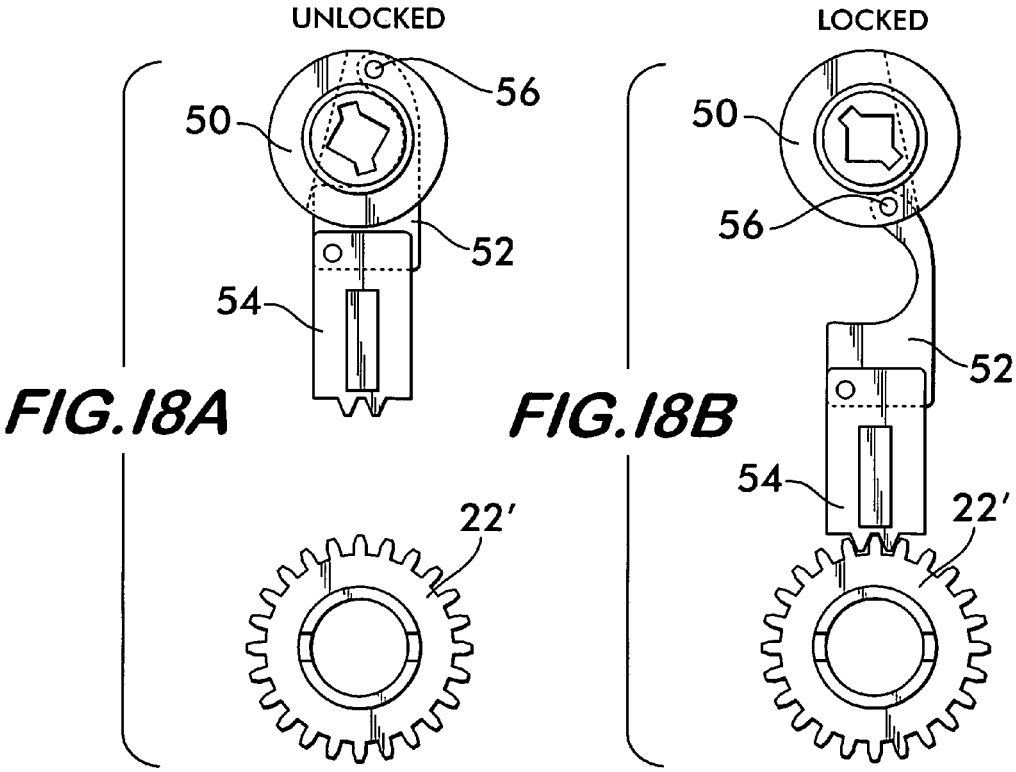
FIG.18A
FIG.18B

CREMONE BOLT OPERATOR

CROSS-REFERENCE TO RELATED APPLICATION

This application claims priority to U.S. Provisional Application Ser. No. 60/461,724, entitled Cremone Bolt Latching Mechanism, filed Apr. 10, 2003, now abandoned.

BACKGROUND OF THE INVENTION

A cremone bolt latching mechanism is a locking mechanism for a door to link two long vertical surface bolts together so that they can be operated in tandem with a knob or lever. Two bolts extend to a cremone operator, i.e., the mechanism that moves the actual bolts. A first bolt extends from the top of the door to the center mounted cremone operator and a second bolt extends from the bottom of the door to the center mounted cremone operator. A cremone bolt mechanism typically is designed to operate with either door knobs or door levers. If door levers are used, the lever is lifted from a horizontal position and rotated about the lever's spindle approximately ninety degrees to retract both the first and the second bolts at the same time. If knobs are used, the knob is rotated (with the top typically rotating towards the lock side of the door) through 180 degrees of rotation to retract both bolts at the same time. The mechanism needs to be adjusted or otherwise modified to change the direction of rotation for either left hand doors or right hand doors.

Past cremone operators were set from the factory for either left hand or right hand operation. They have been manufactured as either knob operators or lever operators. Changing hands required disassembling the mechanism, changing the location of springs and detent balls and or stop pins. Often the parts are reassembled incorrectly or lost all together. Cremone operators for knobs have not been convertible to levers and vice versa.

It would be beneficial to have a cremone bolt mechanism that enables use of a single cremone operator that allows for both lever and knob configurations (i.e., ninety or one hundred eighty degree rotation) and for both left and right opening doors.

BRIEF SUMMARY OF THE INVENTION

A cremone bolt operator is provided which includes a small pinion gear having gear teeth and a central aperture, a large pinion gear having gear teeth and a central aperture, and a first and a second rack gear. Each rack gear has a first and a second set of parallel teeth. The first rack gear and the second rack gear are in opposed relation to one another wherein the first and second sets of teeth are in facing relation. The first set of teeth on each of the first and second rack gear are in meshed engagement with the gear teeth of the small pinion gear and the second set of teeth on each of the first and second rack gear are in meshed engagement with the gear teeth of the large pinion gear. The cremone bolt latching mechanism further includes a spindle having a cross sectional portion sized to fit in each of the central apertures of the small and large pinion gears. A locking device causes the spindle to selectively engage either the small pinion gear or the large pinion gear. Rotational movement of the spindle when the locking device is selectively engaged with either the small pinion gear or the large pinion gear causes a pair of bolts attached to the first and second rack gears of the cremone bolt operator to fully retract by approximately the same amount.

The locking device may take several forms. First, the locking device may be a slot in the spindle and a "T" plate adapted to be inserted into the slot in the spindle in a first and a second orientation. When the "T" plate is in the first orientation, the large pinion gear is held rigidly to the spindle. When the "T" plate is in the second orientation, the small pinion gear is held rigidly to the spindle.

Second, the locking device may be a pair of flat cutouts on the spindle with a pair of cheek plates adapted to be placed flat to the spindle in a first and a second orientation. When the pair of cheek plates is in the first orientation, the large pinion gear is held rigidly to the spindle. When the pair of cheek plates is in the second orientation, the small pinion gear is held rigidly to the spindle.

Third, the locking device may be a pair of longitudinally spaced holes on the spindle and a pin adapted to be placed in one of the longitudinally spaced holes. When the pin is in a first of the longitudinally spaced holes, the large pinion gear is held rigidly to the spindle and when the pin is in a second of the longitudinally spaced holes, the small pinion gear is held rigidly to the spindle.

Optionally, the spindle may include an adjustment feature such that the length of the spindle is adjustable. For example, the adjustment feature may include a two half spindle (i.e., a spindle having two halves) wherein each half of the spindle comprises a half-circular cross sectional shape that has a plurality of holes along the longitudinal length of the spindle. At least one pin is provided that mates with one of the plurality of holes on the opposing half spindle. Here, the two halves of the spindle mate with one another to form a spindle that is generally circular in cross section and adjustable in length by selection of appropriate pairs of the plurality of holes to mate with the pins.

A second embodiment of the cremone bolt attachment assembly includes the above assembly but also has a locking device for the cremone operator. The locking cremone operator includes a rotatable hub adjacent to one of the pinion gears and a bolt linearly movable upon rotation of the rotatable hub. The bolt has at least one tooth engagable with the one of the pinion gears. Rotation of the rotatable hub in a first direction causes the bolt to move linearly in a first direction such that the tooth is in locking engagement with one of the pinion gears. Rotation of the rotatable hub in a second direction causes the bolt to move linearly in a second direction such that the tooth is not engaged with the one of the pinion gears.

In a more detailed embodiment of the present invention, a cremone bolt operator is disclosed which includes a small pinion gear having gear teeth and a central aperture and a large pinion gear having gear teeth and a central aperture. The large pinion gear is coaxial to the small pinion gear and the large pinion gear is free to rotate about its axis independently of the small pinion gear. The cremone bolt operator also includes a first and a second rack gear, each having a first and a second set of parallel teeth. The first rack gear and the second rack gear are in opposed relation to one another wherein the first and second sets of teeth are in facing relation and the first set of teeth on each of the first and second rack gear are in meshed engagement with the gear teeth of the small pinion gear and the second set of teeth on each of the first and second rack gear in meshed engagement with the gear teeth of the large pinion gear. A spindle having a round cross sectional portion is sized to fit in each of the central apertures of the small and large pinion gears. The spindle projects through both the central apertures of the small and large pinion gears. A locking device causes the spindle to selectively engage either the small pinion gear or the large pinion gear such that rotational movement of the spindle causes a selected one of the small pinion gear and the large pinion gear to rotate while allowing a non-selected one of the small pinion gear and the large pinion gear to freely spin about the spindle. Rotational movement of the spindle when the locking device is selectively engaged with either the small pinion gear or the large pinion gear causes a pair of bolts attached to the first and second rack gears of the cremone bolt operator to fully retract by approximately the same amount.

BRIEF DESCRIPTION OF SEVERAL VIEWS OF THE DRAWINGS

The invention will be described in conjunction with the following drawings in which like reference numerals designate like elements throughout the several views and wherein:

FIG. 8 is an isometric view of yet another alternate two sided spindle for use in the cremone bolt latching mechanism of FIG. 4, showing a "T" plate for engaging one of the pinion gears, wherein the length of the spindle is adjustable for varying door thicknesses and wherein the two sided spindle is adapted to be used in a cremone bolt latching mechanism that is operable from two sides of a door;

FIG. 9 an isometric view of an alternate one sided spindle (and cheek plates) for use in the cremone bolt latching mechanism of FIG. 4, showing the pair of cheek plates for engaging one of the pinion gears, wherein the one sided spindle is adapted to be used in a cremone bolt latching mechanism that is operable from one side of a door;

FIG. 10 is an isometric view of a one sided spindle for use in the cremone bolt latching mechanism of FIG. 4. A "T" plate for engaging one of the pinion gears as shown in FIG. 11 is used here. The one sided spindle is adapted to be used in a cremone bolt latching mechanism that is operable from one side of a door;

FIG. 11 is an isometric view of a "T" plate for the spindle as shown in FIGS. 5, 8 and 10;

FIG. 12 is an isometric view of another alternate one sided spindle for use in the cremone bolt latching mechanism of FIG. 4, showing a pin and pair of holes arrangement for engaging one of the pinion gears, wherein the one sided spindle is adapted to be used in a cremone bolt latching mechanism that is operable from one side of a door;

FIG. 17 is an isometric view of a hub, plate and bolt for a locking cremone bolt operator in accordance with a second preferred embodiment of the present invention;

FIG. 18A is a front view of a locking bolt assembly in accordance with the second preferred embodiment of the present invention, shown in an unlocked configuration;

FIG. 18B is a front view of a locking bolt assembly in accordance with the second preferred embodiment of the present invention, shown in a locked configuration;

DETAILED DESCRIPTION OF THE INVENTION

The present design is for a cremone latching mechanism that uses a single cremone operator mounted in an outer case. The operator, once removed from the outer case, can easily and quickly be converted from knob to lever operation and/or configured for left hand to right hand operation, and back. By reinstalling the operator in varying orientations and using varying orientations for a special spindle, as described below, superior handing is achieved and knob/lever requirements for ninety or one hundred eight degree configurations are met.

Figure 1:
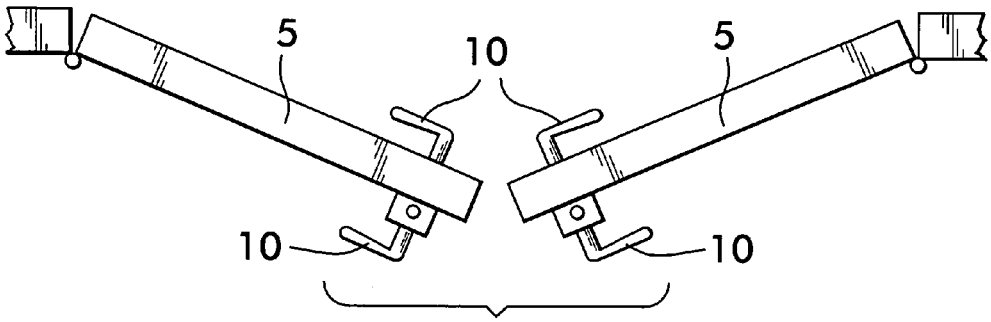
FIG. 1 is a top, plan view of a pair of doors having cremone bolt latching mechanisms attached thereto.
Figure 2:
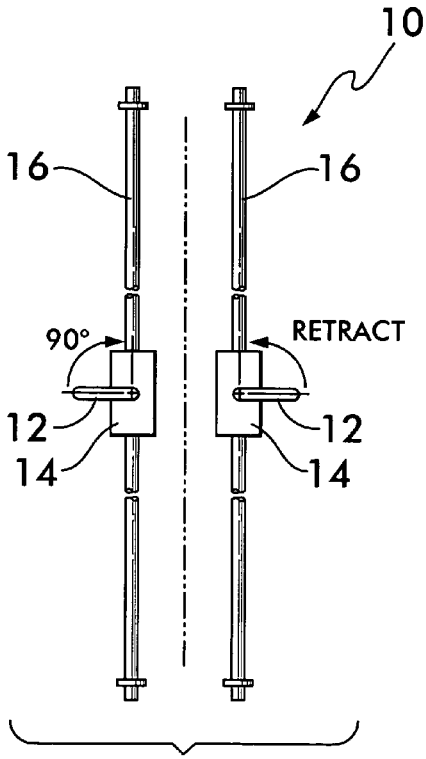
FIG. 2 is a front elevation view of a pair of cremone bolt latching mechanisms as would be attached to a pair of doors wherein the cremone bolt operators provide for rotation of ninety degrees to retract the cremone bolts for use with door levers.

Referring now to the drawings, wherein like part numbers refer to like elements throughout the several views, there is shown in FIG. 1 a top view of a pair of doors 5 having cremone bolt latching mechanisms 10 in accordance with the present invention attached thereto. FIG. 2 is a front elevation view of the pair of cremone bolts latching mechanisms 10 as would be attached to a pair of doors. The doors are not shown for clarity. Cremone bolt operators 14 of the latching mechanisms 10 use mechanisms that rotate ninety degrees to retract the cremone bolts for use with door levers 12. Typically, it is desirable for cremone bolt latching assemblies 10 to have levers 12 that only rotate 90 degrees such that the levers 12, when fully rotated, do not protrude into the space of a facing door. Since sufficient leverage is obtainable by a lever type door handle, the smaller angle of rotation provides for an adequate force applied to the spring tension to disengage the bolts of the latching mechanism 10.

Figure 3:
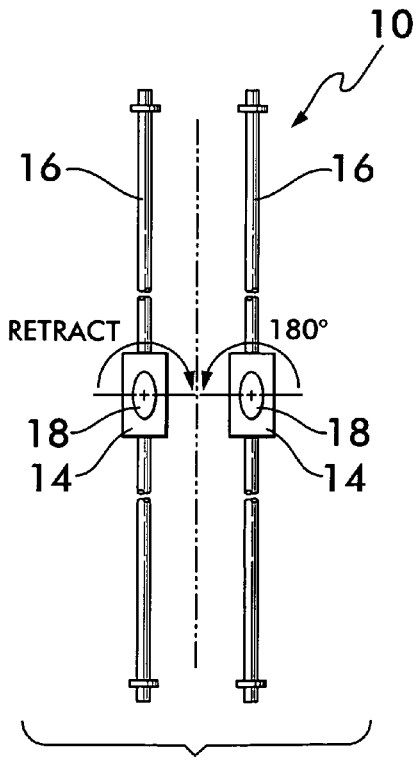
FIG. 3 is a front elevation view of a pair of cremone bolt latching mechanisms as would be attached to a pair of doors wherein the cremone bolt operators provide for rotation of one hundred eighty degrees to retract the cremone bolts for use with door knobs.

FIG. 3 is a front elevation view of a pair of cremone bolt latching mechanisms 10 as would be attached to a pair of doors. Again, the doors are not shown for clarity. Here, the cremone bolt operators 14 use mechanisms that rotate one hundred eighty degrees to retract the cremone bolts 16 for use with door knobs 18 (here, shown as oval shaped knobs). Contrary to the requirements of the operator as configured in FIG. 2, a one hundred eighty degree rotation of the door knobs 18 is desirable such that sufficient leverage is obtained to open the cremone bolts 16.

The cremone bolt operator 14 of the present invention provides for two configurations. A first configuration that provides for a ninety degree rotation of levers 12, as shown in FIG. 2, or a second configuration that provides for a one hundred eighty degree rotation of knobs 18, as shown in FIG. 3.

Figure 4:
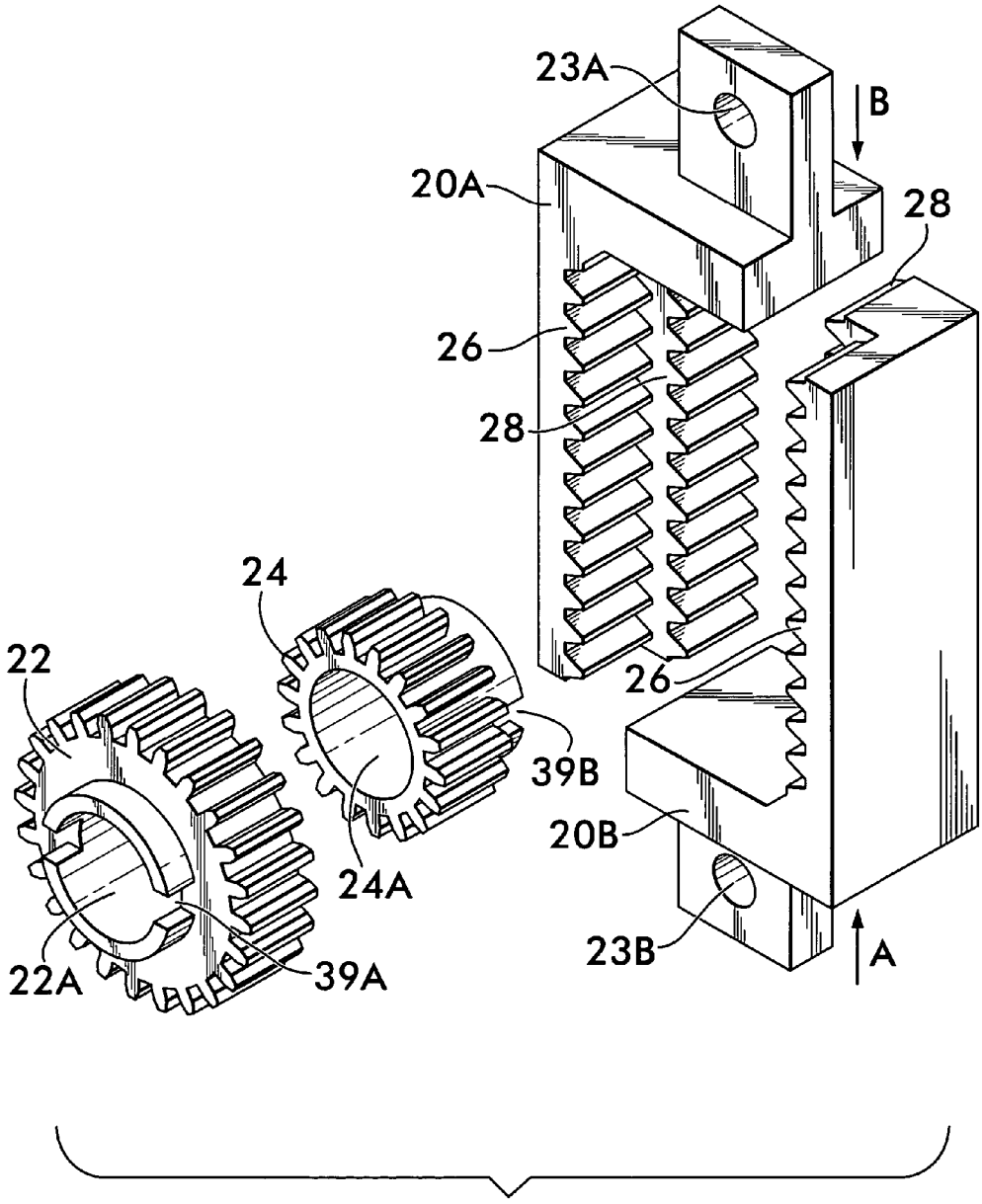
FIG. 4 is an exploded view of a pair of rack gears and a pair of pinion gears for use in an operator of a cremone bolt latching mechanism in accordance with one preferred embodiment of the present invention.

As can best be seen in FIG. 4, the operator operates using a pair of rack gears (a first rack gear 20A and a second rack gear 20B), and a pair of pinion gears (large pinion gear 22 and small pinion gear 24). These two pinion gears 22 and 24 rotate independently about a common axis. Rotation of the small pinion gear 24 (in a lever 12 configuration) by ninety degrees causes the rack gears 20A and 20B to move in directions A and B, respectively, such that the bolts 16 (see FIG. 2), which are attached to the rack gears 20A and 20B at apertures 23A, 23B, move about one inch. Rotation of the large pinion gear 22 is, for example, twice the diameter of the small pinion gear 24. It therefore produces the same motion (here, about one inch) with only 90 degrees of rotation by a lever 12. Each rack gear 20A and 20B has two sets of gear teeth, a first set of gear teeth 28, and a second set of gear teeth 26, that are integral or otherwise permanently attached to their respective rack gear. One hundred eighty degrees of rotation of the small pinion gear 24 moves the rack gears 20A, 20B through its approximately one inch of travel and causes the large pinion 22 to rotate ninety degrees. Ninety degrees of rotation of the large pinion gear 22 causes the rack gears 20A, 20B to move approximately one inch and the small pinion gear 24 to rotate one hundred eighty degrees. By alternately driving either the large pinion gear 22 or the small pinion gear 24, knobs 18 or levers 12 and their appropriate rotational travel can be accommodated.

The drive is selectively delivered to either the large pinion gear 22 or the small pinion gear with a special spindle 30, that mate with slots 39A or 39B in the pinion gears 22, 24, various alternative designs of which are shown in FIGS. 5–12.

Figure 5:
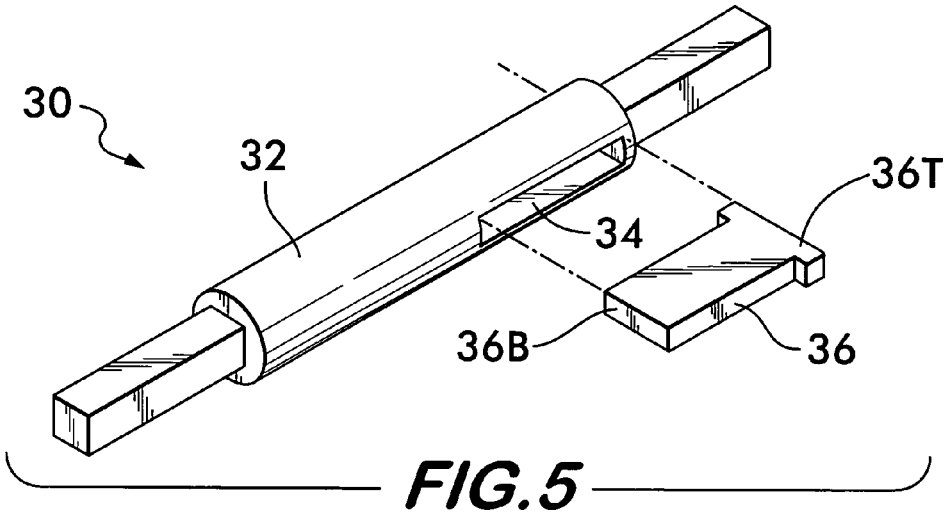
FIG. 5 is an isometric view of a two sided spindle for use in the cremone bolt latching mechanism of FIG. 4, showing a "T" plate for engaging one of the pinion gears, wherein the two sided spindle is adapted to be used in a cremone bolt latching mechanism that is operable from two sides of a door.

As can be seen in FIG. 5, the spindle 30 has a full round cross sectional portion 32 where it passes through the cremone operator 14 (see, e.g., FIG. 4), including central apertures 22A, 24A in both the large pinion gear 22 and the small pinion gear 24. This serves to align both pinions gears 22, 24.

In this full round portion 32 of the spindle 30 there is a through slot 34. A "T" plate 36 is inserted into this slot. By changing the orientation of the "T" plate 36, either the large pinion gear 22 or the small pinion gear 24 may be selected to be driven. That is, if the top 36T of the "T" plate 36 is oriented to the left as shown in FIG. 5, one of either the large pinion gear 22 or the small pinion gear 24 is selected. If the bottom 36B of the "T" plate is oriented to the right (opposite to that shown in FIG. 5), the other of the large pinion gear 22 or the small pinion gear 24 is selected.

Figure 6:
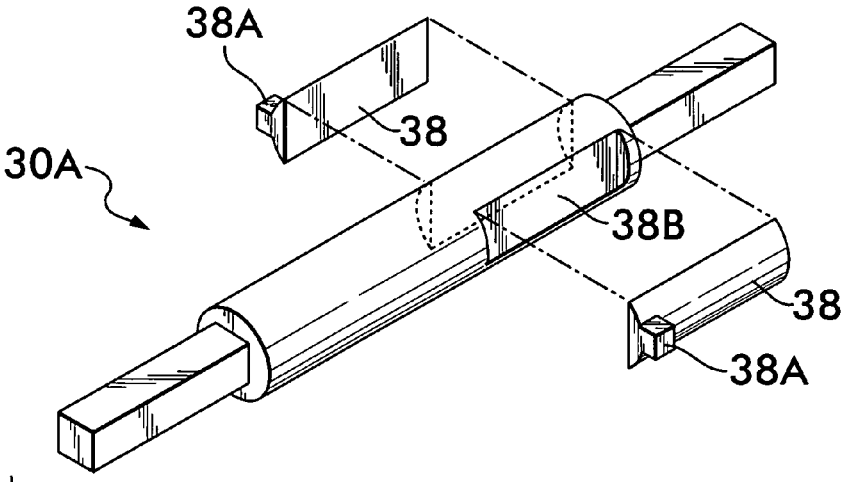
FIG. 6 is an isometric view of an alternate two sided spindle for use in the cremone bolt latching mechanism of FIG. 4, showing a pair of cheek plates for engaging one of the pinion gears, wherein the two sided spindle is adapted to be used in a cremone bolt latching mechanism that is operable from two sides of a door.

FIG. 6 depicts a spindle 30A which is a variation of the spindle 30 of FIG. 5. Here, a pair of cheek plates 38 that may be configured with a pin 38A either to the right or the left as shown in FIG. 6 operates in a similar manner to the spindle 30 of FIG. 5. The cheek plates 38 each sit flush to the spindle in a flat cutout 38B in the spindle 30A.

Figure 7:
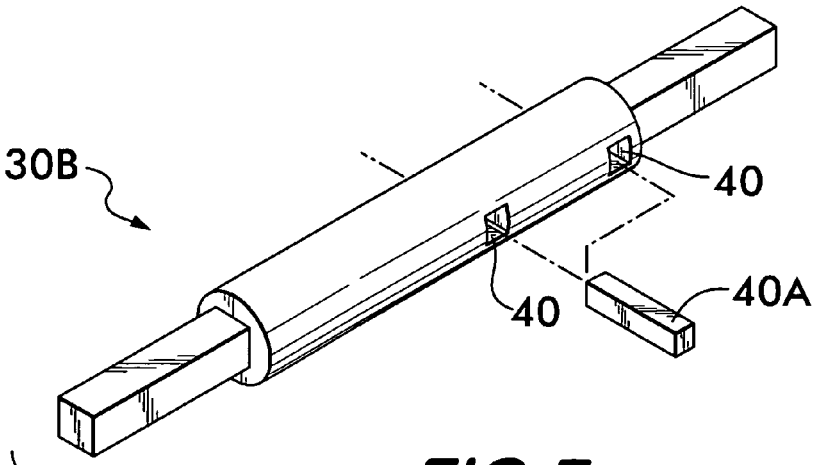
FIG. 7 is an isometric view of another alternate two sided spindle for use in the cremone bolt latching mechanism of FIG. 4, showing a pin and pair of holes arrangement for engaging one of the pinion gears, wherein the two sided spindle is adapted to be used in a cremone bolt latching mechanism that is operable from two sides of a door.

Similarly, FIG. 7 depicts a spindle 30B which is also a variation of the spindle 30 of FIG. 5. Here, a pair of holes 40 in the spindle 30B may be configured with a pin 40A that slides into one or the other of the pair of holes, either to the right or the left as shown in FIG. 7. Again, the result is a spindle 30B having protruding protuberances similar to the spindle 30 of FIG. 5.

While the spindles have been described here with various types of protuberances that ultimately selectively engage slots 39B, 39A in either the small pinion gear 24 or the large pinion gear 22 (respectively), any known locking device associated with the spindle and the pinion gears 22, 24 is anticipated to be within the scope of the present invention.

The spindles 30, 30A and 30B are "two sided" spindles in that they are designed to operate with knobs 18 or levers 12 on two sides of a door. Spindles 30C, 30D and 30E as shown in FIGS. 9, 10 and 12 are "one sided" spindles in that they are designed to have handles or levers on only one side of a door. Otherwise, as can easily be seen, they operate substantially the same as the spindles 30, 30A and 30B described above.

FIG. 11 depicts the "T" plate 36 of FIGS. 5 and 10 (described above and below) and FIG. 8 (described below).

As can be seen in FIG. 8, another spindle 30F is shown that has an adjustable length feature. Here, the spindle 30F operates in accordance with the design of spindle 30, but here the spindle 30F is split into two halves, 42 and 44. Each spindle half 42 and 44 has a pin 42A, 42B, respectively, and a plurality of holes 46. As can easily be seen in FIG. 8, the pins 42A, 42B align with one the holes 46 (the holes in spindle half 42 are not shown) in the opposite half such that a spindle of a desired length may be created. Sleeve 48 slides over the assembly to secure the spindle 30F as a rigid assembly.

Figure 13:
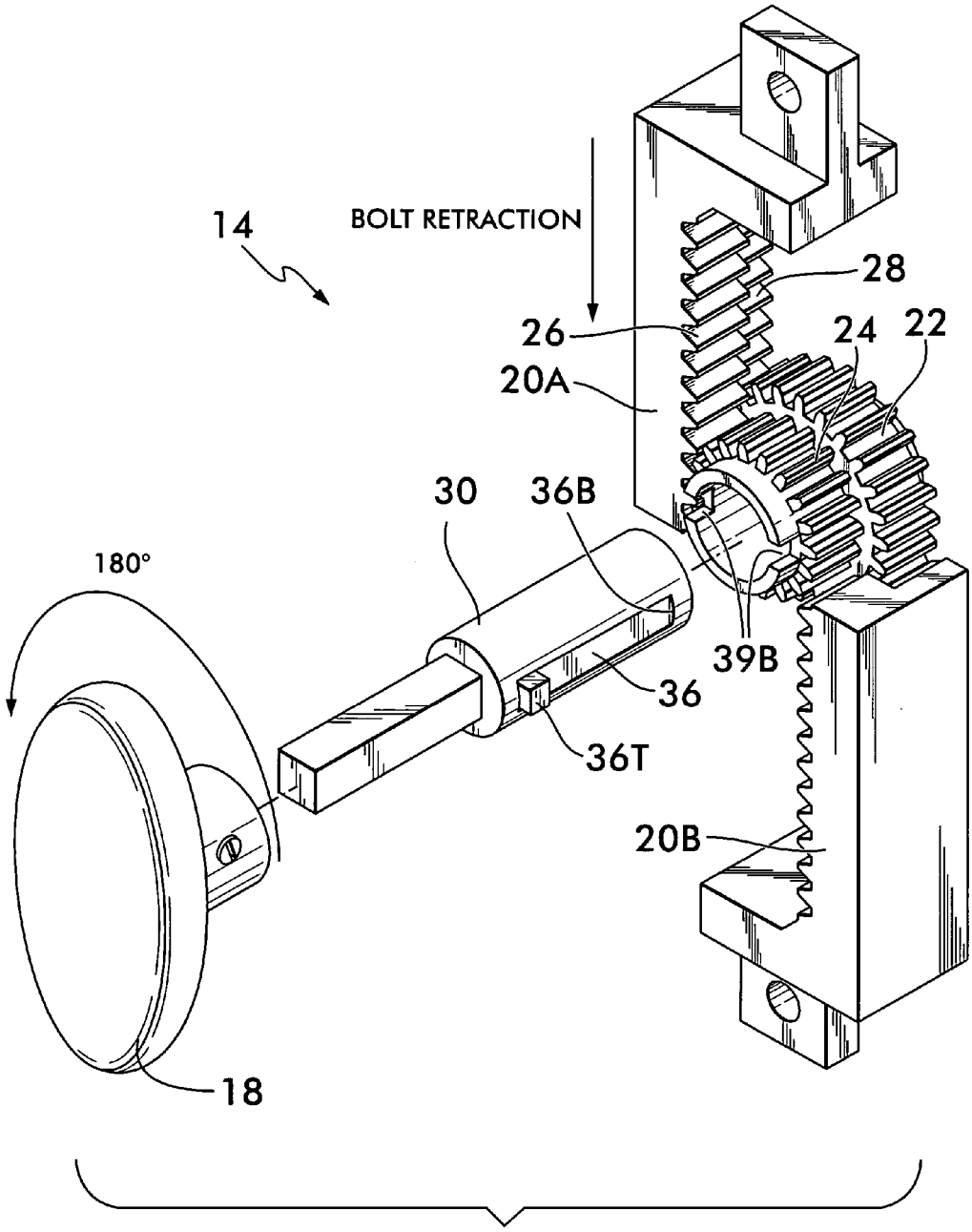
FIG. 13 is an exploded view of a cremone bolt operator mechanism showing a one sided spindle as attached to a door knob that operates by turning one hundred eighty degrees. The right side of this drawing is towards the door to which the cremone bolt operator is attached. The "T" plate engages the small pinion gear. This configuration is for a left hand door.
Figure 14:
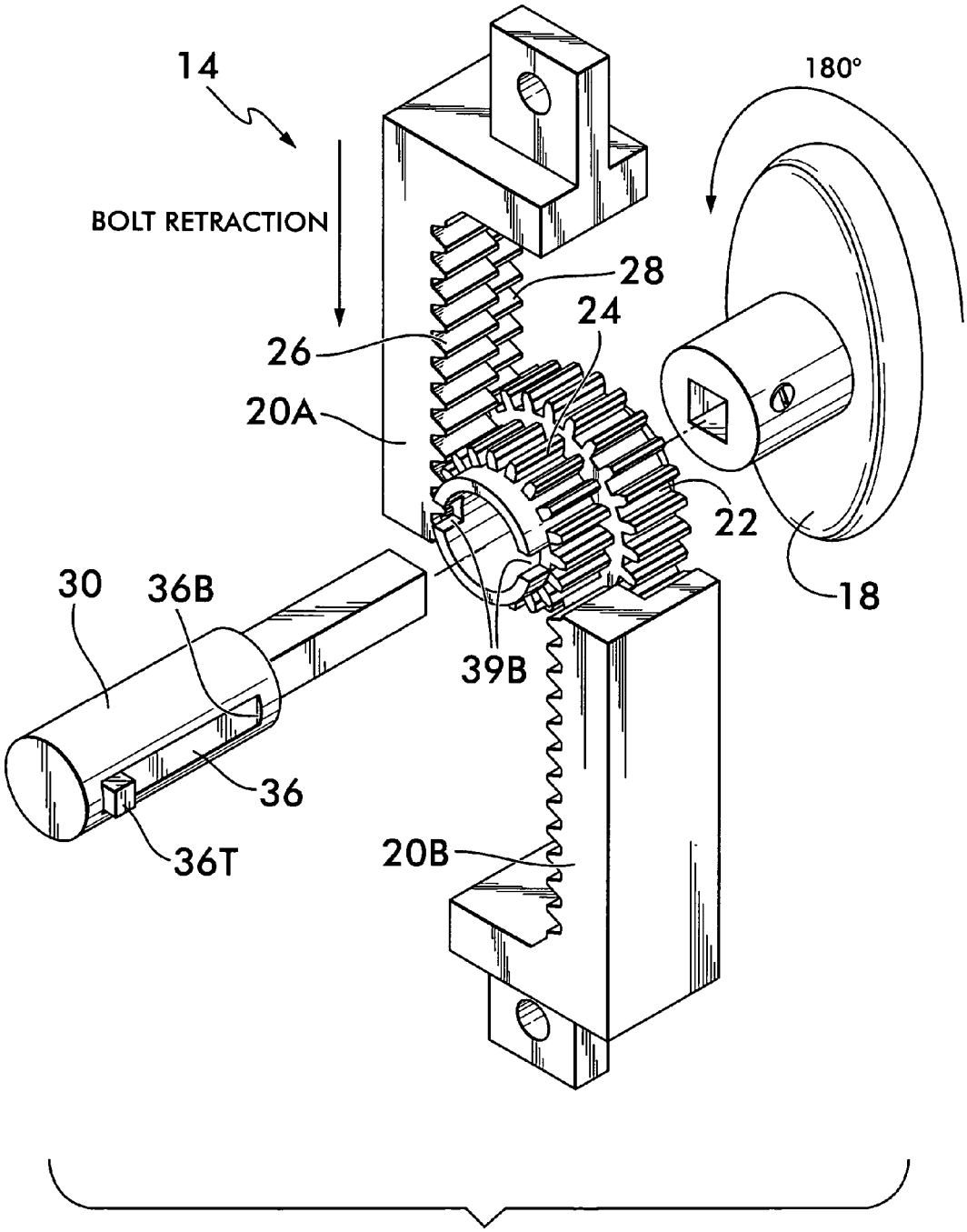
FIG. 14 is an exploded view of a cremone bolt operator mechanism showing a one sided spindle as attached to a door knob that operates by turning one hundred eighty degrees. The left side of this drawing is towards the door to which the cremone bolt operator is attached. The "T" plate engages the small pinion gear. This configuration is for a right hand door.

The spindle 30 (or any of the alternate spindles 30A through 30F) all operate to selectively engage either the large pinion gear 22 or the small pinion gear 24. The operation of spindle 30 will be described in detail here, but suffice it to say that all of the other spindle designs operate in substantially the same manner. As can be seen in FIGS. 13 and 14, if the top 36T of the "T" plate 36 is oriented to the left as shown in FIGS. 13 and 14, the small pinion gear 24 is selected causing the mechanism to require a one hundred eighty degree rotation to fully move the bolts 16 by an appropriate and substantially equal amount, for example, approximately one inch. The protruding portions of the "T" plate engage slot 39B in the small pinion gear 24.

If the bottom 36B of the "T" plate is oriented to the right (opposite to that shown in FIG. 5), the large pinion gear 22 is selected. That is, the protruding portions of the "T" plate engage slot 39A (see FIG. 4) in the large pinion gear 22.

FIG. 13 depicts an exploded view of a cremone bolt operator 14 showing a one sided spindle 30 as attached to a door knob 18 that operates by turning one hundred eighty degrees. The right side of this drawing is towards the door to which the cremone bolt operator 14 is attached. The top 36T of the "T" plate 36 engages the slots 39B in small pinion gear 24. FIG. 14 is an exploded view of a cremone bolt operator mechanism showing a one sided spindle 30 as attached to a door knob 18 that operates by turning one hundred eighty degrees. The left side of this drawing is towards the door to which the cremone bolt operator 14 is attached. Again, the top of the "T" plate 36 engages the small pinion gear 22. It is noted that the teeth 26, 28 of the rack gears 20A and 20B face towards the door (away from the door knob 18 for a single knob configuration) for a left hand opening door and face away from the door (towards the door knob 18 for a single knob configuration) for a right hand opening door.

Figure 15:
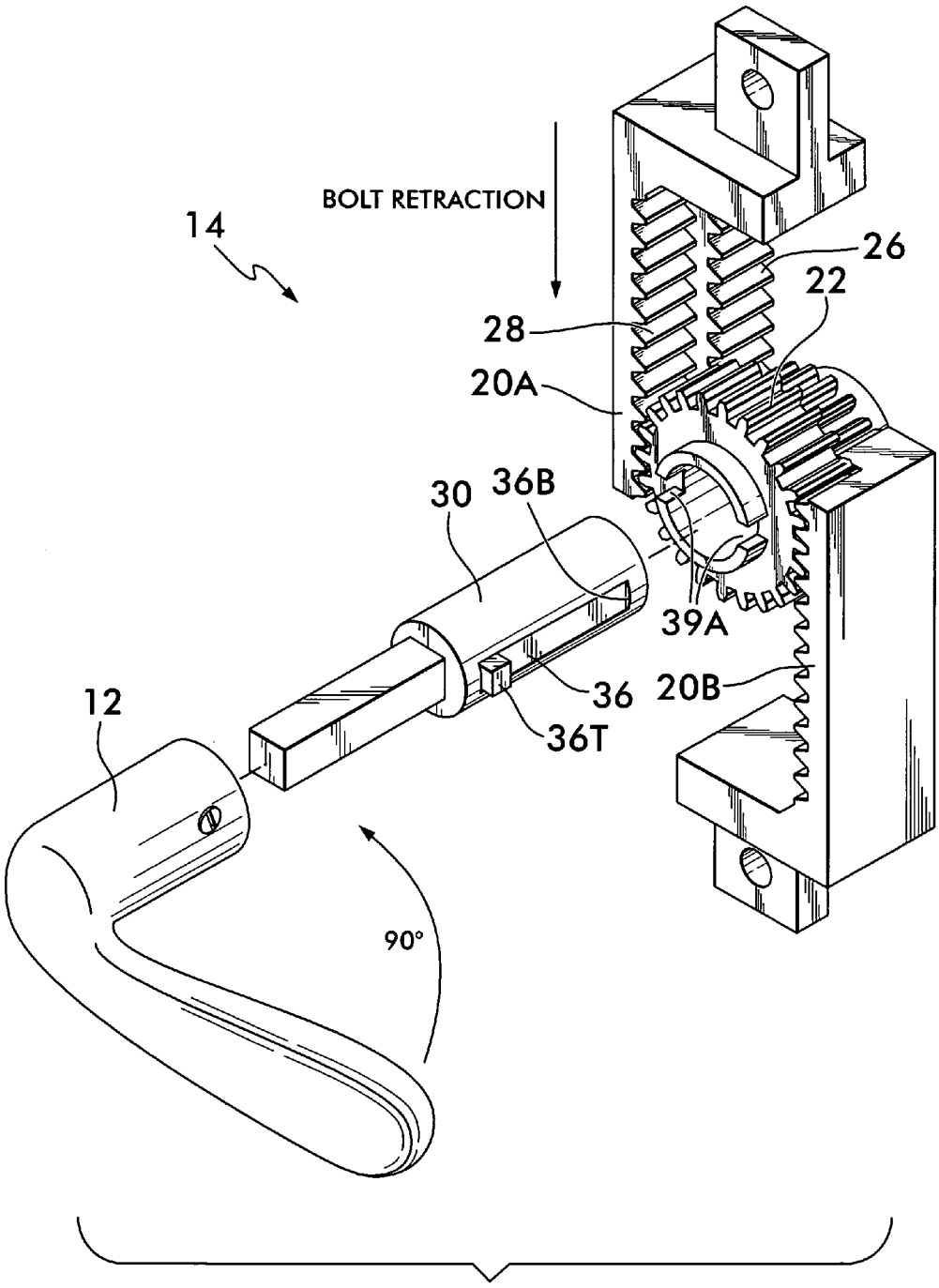
FIG. 15 is an exploded view of a cremone bolt operator mechanism showing a one sided spindle as attached to a door lever that operates by turning ninety degrees. The right side of this drawing is towards the door to which the cremone bolt operator is attached. The "T" plate engages the large pinion gear. This configuration is for a left hand door.
Figure 16:
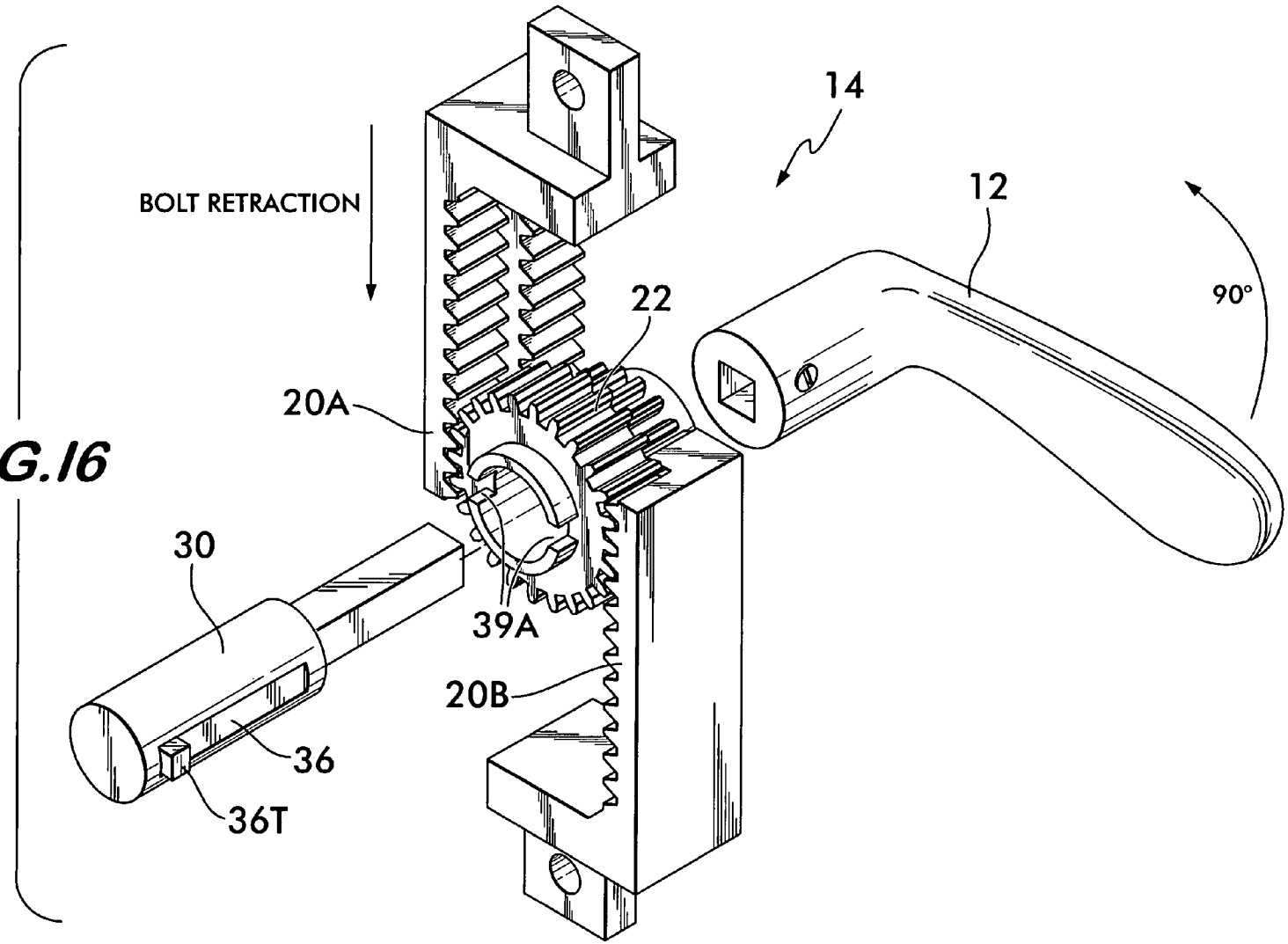
FIG. 16 is an exploded view of a cremone bolt operator mechanism showing a one sided spindle as attached to a door lever that operates by turning ninety degrees. The left side of this drawing is towards the door to which the cremone bolt operator is attached. The "T" plate engages the large pinion gear. This configuration is for a right hand door.
Figure 19:
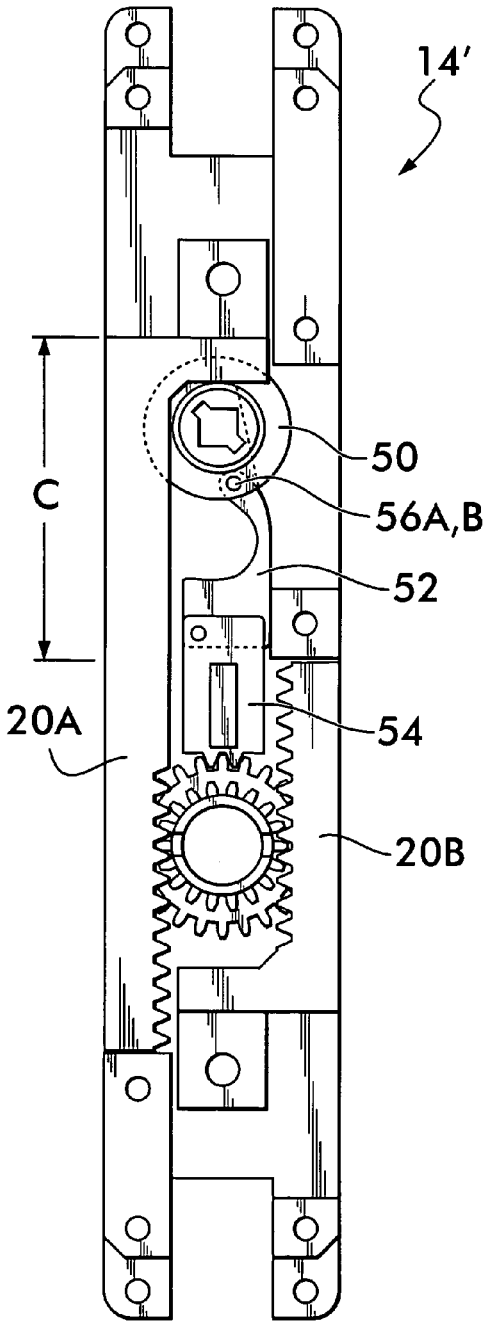
FIG. 19 is a front elevation view a cremone bolt latching mechanism in accordance with the second embodiment of the present invention.
Figure 20:
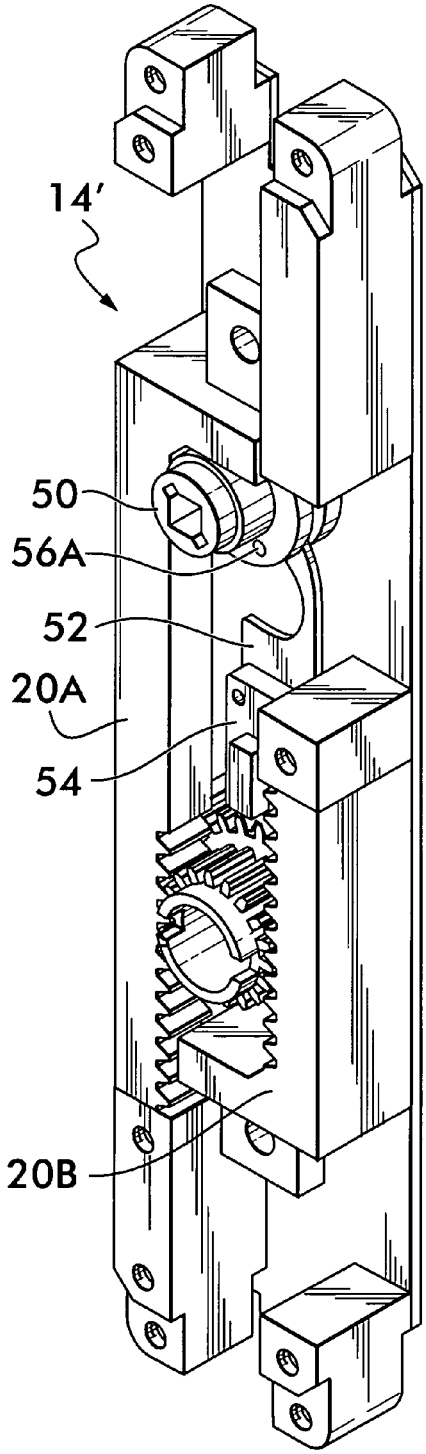
FIG. 20 is an isometric view of the cremone bolt latching mechanism of FIG. 19.

FIG. 15 depicts an exploded view of a cremone bolt operator 14 showing a one sided spindle 30 as attached to a door lever 12 that operates by turning ninety degrees. The right side of this drawing is towards the door to which the cremone bolt operator is attached. The top of the "T" plate 36T engages slots 39A of the large pinion gear 22. This configuration is for a left hand opening door. FIG. 16 depicts exploded view of a cremone bolt operator 14 showing a one sided spindle 30 as attached to a door lever 12 that operates by turning ninety degrees. The left side of this drawing is towards the door to which the cremone bolt operator is attached. The "T" plate 36 engages slot 39A of the large pinion gear 22. This configuration is for a right hand opening door. It is noted that the gears 26, 28 of the rack gears 20A and 20B face away from the door (towards the lever 12) for a left hand opening door and towards the door (away from the lever 12 for a single lever configuration) for a right hand opening door. The pinion gears 22, 24 are also configured so that they properly mate with the rack gears 20A, 20B. The pinion gears 22, 24 are also configured so that they properly mate with the rack gears 20A, 20B.

To configure for a left hand from a configuration for a right hand door, the rack gears 20A and 20B and the pinion gears 22, 24 are rotated one hundred eighty degrees relative to the door.

As can be seen in FIGS. 17 through 20, another variation on the cremone operator is a locking feature in accordance with a second preferred embodiment of the present invention. The locking feature uses the same basic mechanism as cremone operator 14, as described above. However, in the locking cremone operator 14', one of the rack gears 20A is lengthened, noted by callout C in FIG. 19, so that there is additional space, for example, 2.5 to 3 inches of space, for additional mechanism. A deadbolt feature is now located in this space.

In a normal deadbolt application, a mechanism similar to that of FIG. 17 is installed in a case which will fit into a 1" diameter hole drilled into the edge of a door. The end of the case typically has a face plate 1" wide by 2.5" high. This face plate has two holes for mounting screws. The hub of the deadbolt mechanism (for example, similar to hub 50 as shown in FIG. 17), is turned through 180 degrees. This forces the plate (analogous to that of plate 52 of FIG. 17) and bolt (analogous to that of bolt 54 of FIG. 17) forward. The bolt extends from the edge of the door and locks into the jamb.

In the locking cremone operator 14' of the second preferred embodiment of the present invention, a deadbolt case (as is usually used with deadbolts) is deleted. A hub 50, plate 52 and bolt 54 are installed in the cremone case (not shown for clarity). Rotation of the deadbolt hub 50 forces the bolt 54 towards the large pinion gear 22' by pinned pivot point 56 which comprises a pair of holes 56A in the hub 50 and a hole 56B in the pivot plate 52. The end of the bolt 54 has one or more gear teeth 58 which engage the large pinion 22' (see FIGS. 18A and 18B) and prevents movement of the entire gear train. The plate 52 preferably has a peripheral configuration, for example, as shown in FIG. 17, to provide appropriate clearance for full movement of the bolt 54.

Preferably, the hub 50 rotated through one hundred eighty degrees to lock or unlock the cremone operator. This rotation drives the plate 52 which in turn drives the bolt 54 with at least one gear tooth 58 that engages one of the pinions in the cremone operator. The deadbolt is operated from the inside of the door with a turnpiece and from the outside with a rim cylinder, as known in the art.

A primary difference between the present design and existing cremone designs is that the locking mechanism on other cremone bolts is only accessible from the inside. In addition, the lock is located off center from the bolts. This yields a less than desirable appearance. The present design results in a bolt where the lock is mounted in line with the bolts and is located on the outside of the door. Inside access is by turnpiece.

While the invention has been described in detail and with reference to specific embodiments thereof, it will be apparent to one skilled in the art that various changes and modifications can be made therein without departing from the spirit and scope thereof.

What is claimed is:

1. A cremone bolt operator, comprising:

(a) a small pinion gear having gear teeth and a central aperture;

(b) a large pinion gear having gear teeth and a central aperture;

(c) a first and a second rack gear, each rack gear having a first and a second set of parallel teeth, said first rack gear and said second rack gear in opposed relation to one another wherein the first and second sets of teeth are in facing relation, said first set of teeth on each of the first and second rack gear in meshed engagement with the gear teeth of the small pinion gear and the second set of teeth on each of the first and second rack gear in meshed engagement with the gear teeth of the large pinion gear;

(d) a spindle having a cross sectional portion sized to fit in each of the central apertures of the small and large pinion gears; and (e) a locking device that causes the spindle to selectively engage either the small pinion gear or the large pinion gear;

whereby rotational movement of the spindle when the locking device is selectively engaged with either the small pinion gear or the large pinion gear causes a pair of bolts attached to the first and second rack gears of the cremone bolt operator to fully retract by approximately the same amount.

2. The cremone bolt latching assembly of claim 1, wherein the locking device is a slot in the spindle and a "T" plate adapted to be inserted into the slot in the spindle in a first and a second orientation, wherein when the "T" plate is in the first orientation, the large pinion gear is held rigidly to the spindle and when the "T" plate is in the second orientation, the small pinion gear is held rigidly to the spindle.

3. The cremone bolt latching assembly of claim 1, wherein the locking device is a pair of flat cutouts on the spindle and a pair of cheek plates adapted to be placed flat to the spindle in a first and a second orientation, wherein when the pair of cheek plates is in the first orientation, the large pinion gear is held rigidly to the spindle and when the pair of cheek plates is in the second orientation, the small pinion gear is held rigidly to the spindle.

4. The cremone bolt latching assembly of claim 1, wherein the locking device is a pair of longitudinally spaced holes on the spindle and a pin adapted to be placed in one of the longitudinally spaced holes, wherein when the pin is in a first of the longitudinally spaced holes, the large pinion gear is held rigidly to the spindle and when pin is in a second of the longitudinally spaced holes, the small pinion gear is held rigidly to the spindle.

5. The cremone bolt latching assembly of claim 1, wherein the spindle includes an adjustment feature such that the length of the spindle is adjustable.

6. The cremone bolt latching assembly of claim 5, wherein the adjustment feature includes a two half spindle wherein each half of the spindle comprises a half-circular cross sectional shape that has a plurality of holes along the longitudinal length of the spindle, and at least one pin that mates with one of the plurality of holes in its opposing half spindle, wherein the two halves of the spindle mate with one another to form a spindle that is generally circular in cross section and adjustable in length by selection of appropriate pairs of the plurality of holes to mate with the pins.

7. The cremone bolt latching assembly of claim 1, further including a locking cremone operator, wherein the locking cremone operator comprises:

(a) a rotatable hub adjacent one of the pinion gears;

(b) a bolt linearly movable upon rotation of the rotatable hub, said bolt having at least one tooth engagable with said one of the pinion gears;

(c) rotation of the rotatable hub in a first direction causes the bolt to move linearly in a first direction such that the at least one tooth is in locking engagement with the one of the pinion gears; and (d) rotation of the rotatable hub in a second direction causes the bolt to move linearly in a second direction such that the at least one tooth is not engaged with the one of the pinion gears.

8. A cremone bolt operator, comprising:

(a) a small pinion gear having gear teeth and a central aperture;

(b) a large pinion gear having gear teeth and a central aperture, said large pinion gear coaxial to said small pinion gear, said large pinion gear being free to rotate about its axis independently of the small pinion gear;

(c) a first and a second rack gear, each rack gear having a first and a second set of parallel teeth, said first rack gear and said second rack gear in opposed relation to one another wherein the first and second sets of teeth are in facing relation, said first set of teeth on each of the first and second rack gear in meshed engagement with the gear teeth of the small pinion gear and the second set of teeth on each of the first and second rack gear in meshed engagement with the gear teeth of the large pinion gear;

(d) a spindle having a round cross sectional portion sized to fit in each of the central apertures of the small and large pinion gears, said spindle projecting through both the central apertures of the small and large pinion gears; and (e) a locking device to causes the spindle to selectively engage either the small pinion gear or the large pinion gear such that rotational movement of the spindle causes a selected one of the small pinion gear and the large pinion gear to rotate while allowing a non-selected one of the small pinion gear and the large pinion gear to freely spin about the spindle;

whereby rotational movement of the spindle when the locking device is selectively engaged with either the small pinion gear or the large pinion gear causes a pair of bolts attached to the first and second rack gears of the cremone bolt operator to fully retract by approximately the same amount.

9. The cremone bolt latching assembly of claim 8, wherein the locking device is a slot in the spindle and a "T" plate adapted to be inserted into the slot in the spindle in a first and a second orientation, wherein when the "T" plate is in the first orientation, the large pinion gear is held rigidly to the spindle and when the "T" plate is in the second orientation, the small pinion gear is held rigidly to the spindle.

10. The cremone bolt latching assembly of claim 8, wherein the locking device is a pair of flat cutouts on the spindle and a pair of cheek plates adapted to be placed flat to the spindle in a first and a second orientation, wherein when the pair of cheek plates is in the first orientation, the large pinion gear is held rigidly to the spindle and when the pair of cheek plates is in the second orientation, the small pinion gear is held rigidly to the spindle.

11. The cremone bolt latching assembly of claim 8, wherein the locking device is a pair of longitudinally spaced holes on the spindle and a pin adapted to be placed in one of the longitudinally spaced holes, wherein when the pin is in a first of the longitudinally spaced holes, the large pinion gear is held rigidly to the spindle and when pin is in a second of the longitudinally spaced holes, the small pinion gear is held rigidly to the spindle.

12. The cremone bolt latching assembly of claim 8, wherein the spindle includes an adjustment feature such that the length of the spindle is adjustable.

13. The cremone bolt latching assembly of claim 12, wherein the adjustment feature includes a two half spindle wherein each half of the spindle comprises a half-circular cross sectional shape that has a plurality of holes along the longitudinal length of the spindle, and at least one pin that mates with one of the plurality of holes in its opposing half spindle, wherein the two halves of the spindle mate with one another to form a spindle that is generally circular in cross section and adjustable in length by selection of appropriate pairs of the plurality of holes to mate with the pins.

14. The cremone bolt latching assembly of claim 8, further including a locking cremone operator, wherein the locking cremone operator comprises:

(a) a rotatable hub adjacent one of the pinion gears;

(b) a bolt linearly movable upon rotation of the rotatable hub, said bolt having at least one tooth engagable with said one of the pinion gears;

(c) rotation of the rotatable hub in a first direction causes the bolt to move linearly in a first direction such that the at least one tooth is in locking engagement with the one of the pinion gears; and (d) rotation of the rotatable hub in a second direction causes the bolt to move linearly in a second direction such that the at least one tooth is not engaged with the one of the pinion gears.

* * * * *